United States Patent [19]

Ota

[11] 3,998,192

[45] Dec. 21, 1976

[54] IGNITION TIMING CHANGE-OVER DEVICE

[75] Inventor: Isamu Ota, Toyota, Japan

[73] Assignee: Toyota Jidosha Kogyo Kabushiki Kaisha, Toyota, Japan

[22] Filed: Feb. 18, 1975

[21] Appl. No.: 550,670

[30] Foreign Application Priority Data

Aug. 31, 1974 Japan ..... 49-100020

[52] U.S. Cl. ..... 123/117 A

[51] Int. Cl.[2] ..... F02P 5/06

[58] Field of Search ..... 123/117 A

[56] References Cited

UNITED STATES PATENTS

| | | | |
|---|---|---|---|
| 3,680,533 | 8/1972 | Soberski | 123/117 A |
| 3,730,154 | 5/1973 | Vartanlan | 123/117 A |
| 3,812,832 | 5/1974 | Scott | 123/117 A |
| 3,841,551 | 10/1974 | Ota | 123/117 A |

*Primary Examiner*—Wendell E. Burns
*Assistant Examiner*—David D. Reynolds
*Attorney, Agent, or Firm*—Stevens, Davis, Miller & Mosher

[57] ABSTRACT

An ignition timing change-over device for an internal combustion engine comprising a vacuum advancer for causing rotation of the breaker plate of the contact breaker toward an ignition timing advancing direction, a vacuum retarder for causing rotation of the breaker plate toward an ignition timing retarding direction, a first valve unit connected to the vacuum advancer and vacuum retarder, and a second valve unit connected to the vacuum retarder and the first valve unit. The first valve unit is used for supplying the suction vacuum into the vacuum advancer when the temperature of the engine is lower than a predetermined value, supplying the suction vacuum into the vacuum retarder when the engine temperature is higher than the predetermined value, and supplying the suction vacuum into the vacuum advancer when the engine temperature is higher than the predetermined value and the vacuum in the intake manifold is higher than a predetermined value, while the second valve unit acts to permit communication between the vacuum retarder and the atmosphere when the vacuum in the intake manifold is higher than the predetermined value and to permit communication between the vacuum retarder and the first valve unit when the vacuum in the intake manifold is lower than the predetermined value, so that the ignition timing can be changed depending on variations of the two variables, that is, the engine temperature and the intake manifold vacuum.

4 Claims, 5 Drawing Figures

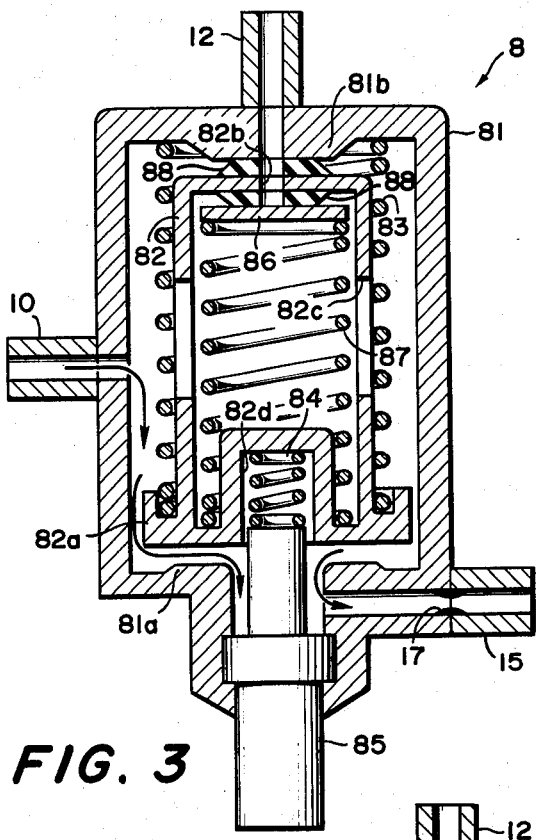
FIG. 3
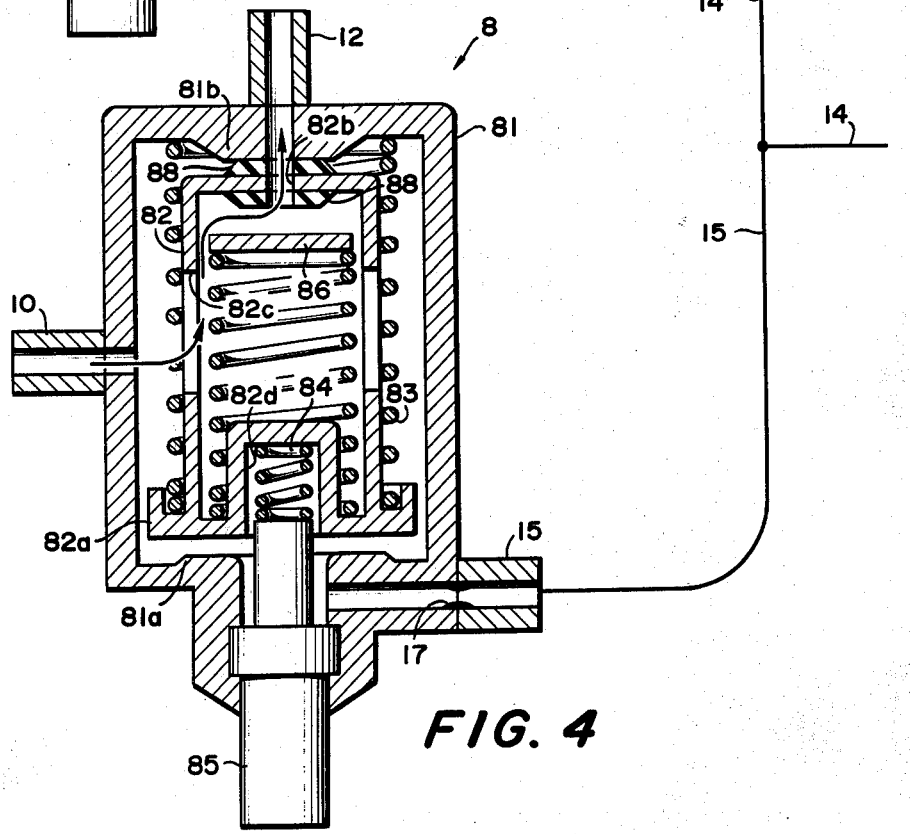
FIG. 4
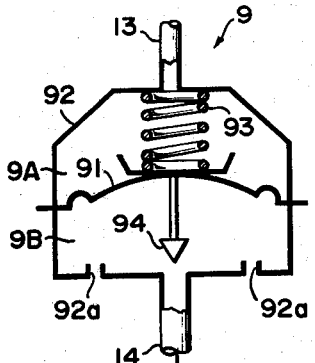

IGNITION TIMING CHANGE-OVER DEVICE

BACKGROUND OF THE INVENTION

This invention relates to an ignition timing change-over device for internal combustion engines.

Various pollutants such as non-burnt hydrocarbons, carbon monoxide and nitrogen oxides, are produced in the course of combustion of fuel in an internal combustion engine. Retarding of ignition timing is known as an effective method for reduction of the amounts of the pollutants. So, a method of retarding the ignition timing over the entire operating range of an engine is commonly used in the art. However, this well-known method has a defect in that retardation of the ignition timing results in an undesirable reduction of the operation performance of the engine in the engine operating region in which the amounts of the production of the pollutants are relatively small. Various proposals have been made hitherto for obviating such defect by changing the ignition timing depending on the operating condition of the engine. One of such proposals intends to improve the starting performance of the engine, and at the same time, to reduce the amounts of the pollutants produced during idling. According to the proposal, the ignition timing is advanced before the upper dead point in the engine starting stage only, and is retarded after the upper dead point after the engine is started.

In studying the improvements on the reduction of engine performance due to advancing the ignition timing, the inventors of the present invention have found that the operating performance of the engine at a low temperature (that is, in a temperature range in which the engine cooling water is lower than 40° C) can be improved by advancing the ignition timing more than that in a higher engine temperature range. A series of inventions based on the fact have been disclosed already.

Various other proposals have been made in an attempt to eliminate undesirable reductions of the engine operating performance due to the advanced ignition timing.

For example, U.S. Pat. No. 3,593,693 discloses an invention which aims to reduce the amounts of the pollutants produced during the running condition of a vehicle when the vehicle is coasting at a high speed and the throttle valve in the carburetor is closed in spite of the fact that the rotating speed of the engine is high. This prior art invention is featured by the fact that the ignition timing is advanced when the engine is rotating at a high speed in spite of the closure of the throttle valve, and the ignition timing is retarded subsequently when the speed of the engine is reduced to a level lower than a predetermined value.

U.S. Pat. No. 3,717,135 discloses an invention which intends to eliminate undesirable reductions of the operating performance in an engine in the starting stage as in the proposals above described. According to this prior art invention, the ignition timing is advanced during the engine starting stage and is then retarded after the engine is warmed to a temperature above a predetermined value so as to improve the engine starting performance, to ensure smooth operation of the engine during idling and to reduce production of the pollutants in a steady running condition.

Some of the above-mentioned proposals employ a dual point type contact breaker which operates independently of a known vacuum advancer. In some of the remaining proposals, a device is used in which a control mechanism responsive to the engine temperature is combined with a single point type contact breaker and a known vacuum advancer. In this latter device, the advancer is controlled depending on the combination of two variables, that is, the detected value of the engine temperature and the detected value of the load of the engine. Thus, this latter device is advantageous in that it can control the ignition timing more effectively and the size thereof is smaller than the devices of the other proposals.

The latter device above described is featured by the fact that the ignition timing is changed over the entire operating range of the engine in consideration of both the improvement in the engine operating performance and the reduction in the amounts of the pollutants discharged from the engine, and is used in combination with a known vacuum advancer. This latter device comprises a first valve responsive to the pressure at a point upstream of the throttle valve in the carburetor, a second valve responsive to the pressure at a point downstream of the carburetor throttle valve, and restraining means for restraining or releasing the valve rods of the first and second valves depending on the temperature of the engine. According to this device, the known vacuum advancer responds to the pressure on the downstream side of the carburetor throttle valve when the speed of the engine is increasing, and the pressure on the upstream side of the carburetor throttle valve is supplied into the vacuum advancer to render the vacuum advancer inoperative, or the vacuum advancer is advanced a suitable angle determined by a pressure intermediate the pressures on the upstream and downstream sides of the carburetor throttle valve when the steady state is reached and the engine is rotating at a constant speed. However, this device is also defective in that the ignition timing cannot be changed over all the operating conditions of the engine due to the fact that the ignition timing cannot be retarded to suit a specific operating condition of the engine. The present invention obviates such a defect.

SUMMARY OF THE INVENTION

It is a primary object of the present invention to provide a novel and improved ignition timing change-over device for an internal combustion engine which is capable of changing the ignition timing to suit various operating conditions of the engine so as to improve the operating performance of the engine over the entire operating range.

The present invention is featured by the fact that the ignition timing is advanced when the temperature of an engine is lower than a predetermined value, the ignition timing is retarded when the temperature of the engine attains a level above the predetermined value, and the ignition timing is advanced also in the case in which the temperature of the engine is higher than the predetermined value and the vacuum in the intake manifold attains a level higher than a predetermined value.

The ignition timing change-over device for an internal combustion engine according to the present invention comprises a vacuum advancer for causing rotation of the breaker plate in the contact breaker toward an ignition timing advancing direction, a vacuum retarder for causing rotation of said breaker plate toward an ignition timing retarding direction, first vacuum transmitting means communicating with a first position downstream of the throttle valve in the carburetor for transmitting vacuum from said first position, second vacuum transmitting means communicating with the intake manifold at a second position downstream of said first position for transmitting vacuum from said second position, third vacuum transmitting means communicating with a third position upstream of said throttle valve for transmitting vacuum from said third position to supply the vacuum into said vacuum advancer, a first valve unit connected to said first vacuum transmitting means, a second valve unit connected to said second vacuum transmitting means, a first conduit connecting said third vacuum transmitting means to said first valve unit, a second conduit extending between said second valve unit and said vacuum retarder, and a third conduit branched from said second conduit to be connected to said first valve unit, said first valve unit including a first valve member for interrupting communication between said first vacuum transmitting means and said first conduit when the temperature of the engine is higher than a predetermined value and the vacuum in the intake manifold is lower than a predetermined value, a second valve member for permitting commmunication between said first vacuum transmitting means and said third conduit when the temperature of the engine is higher than the predetermined value, and a third valve member for permitting communication between said first vacuum transmitting means and said first conduit when the temperature of the engine is higher than the predetermined value and the vacuum in the intake manifold is higher than the predetermined value, and said second valve unit including a valve member for permitting communication between said second conduit and said third conduit when the vacuum in the intake manifold is lower than the predetermined value and permitting communication between said second conduit and the atmosphere when the vacuum in the intake manifold becomes higher than the predetermined value.

In the device of the present invention having the features above described, the first valve unit interrupts communication between the first vacuum transmitting means and the first conduit when the temperature of the engine is higher than the predetermined value and the vacuum in the intake manifold is lower than the predetermined value, and communication between the first vacuum transmitting means and the third conduit is established by the first valve unit when the temperature of the engine is higher than the predetermined value, while communication between the first vacuum transmitting means and the first conduit is established by the first valve unit when the temperature of the engine is higher than the predetermined value and the vacuum in the intake manifold is higher than the predetermined value. In the device, the second valve unit permits communication between the second conduit and the third conduit when the vacuum in the intake manifold is lower than the predetermined value, and the second conduit communicates with the atmosphere through the second valve unit when the vacuum in the intake manifold becomes higher than the predetermined value. Thus, the ignition timing is advanced or retarded by a single device depending on variations of the two variables, that is, the temperature of the engine and the vacuum in the intake manifold.

BRIEF DESCRIPTION OF THE DRAWINGS

FIG. 3 is a view similar to FIG. 2 but showing the state of the first valve unit when the temperature of the engine is high.

FIG. 4 is an enlarged longitudinal sectional view of the first and second valve units in the state in which the temperature of the engine is high and the vacuum in the intake manifold is high.

DETAILED DESCRIPTION OF THE INVENTION

Figure 1:
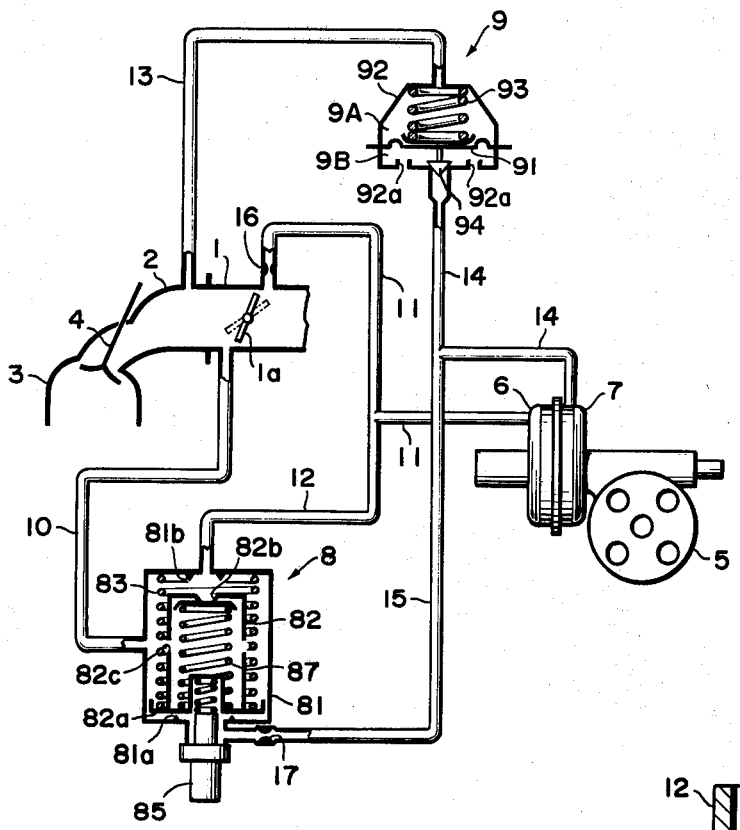
FIG. 1 is a diagrammatic view showing the general structure of an embodiment of the ignition timing changeover device of the present invention with a first and a second valve unit shown in section.

FIG. 1 of the accompanying drawings shows diagrammatically the structure of an embodiment of the ignition timing change-over system according to the present invention.

Referring to FIG. 1, reference numerals 1, 1*a*, 2, 3 and 4 designate a known carburetor, a throttle valve, an intake manifold, one of cylinders of an internal combustion engine, and an inlet valve respectively. A high voltage is applied by a distributor 5 to ignition plugs (not shown) provided in the respective cylinders. A vacuum advancer 6 and a vacuum retarder 7 forming part of the system of the present invention are connected to this distributor 5.

Figure 5:
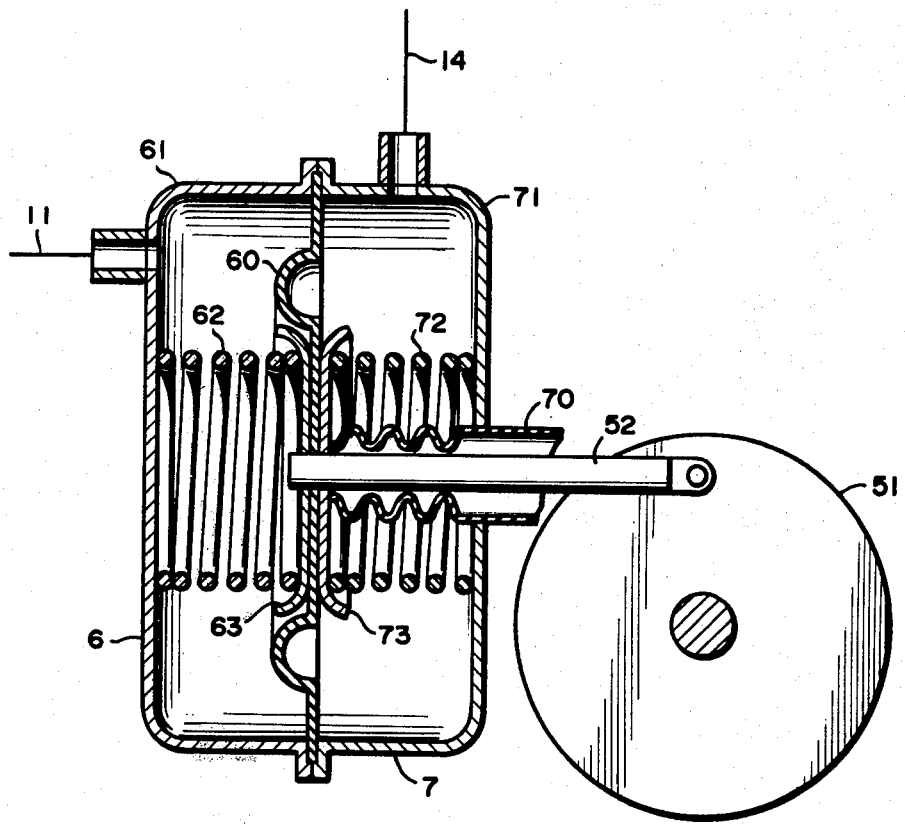
FIG. 5 is a vertical sectional view showing the vacuum advancer and the vacuum retarder, wherein the connection relationships between the vacuum advancer and the vacuum retarder and the distributer are shown.

As shown in FIG. 5, the vacuum advancer 6 and the vacuum retarder 7 are constructed integrally as a single assembly by connecting their respective casings 61 and 71 through a diaphragm 60 disposed between the open ends of the casings 61 and 71. Coil springs 62 and 72 are disposed within the casings 61 and 71, respectively and the intensities of the springs 62 and 72 are equal to each other. One end of the coil spring 62 is contacted against the inner surface of the end wall of the casing 61 and the other end is contacted against the disc 63 disposed between the other end and the diaphragm 60. One end of the coil spring 72 is contacted against the inner surface of the end wall of the casing 71 and the other end of this coil spring 72 is contacted against the disc 73 disposed between the other end and the diaphragm 60. According to the construction above described, when the pressures in the advancer and the retarder are equal to one another, the diaphragm 60 is positioned at its neutral position.

The spaces defined by the casings 61 and 71 and the diaphragm are equal in volume to each other and communicated with conduits 11 and 14, respectively.

A connecting rod 52 is secured to the central portion of the diaphragm 60 at the inner end thereof. The connecting rod 52 extends through the end wall of the casing 71 and the outer end is pivotally connected to a breaker plate 51 of a distributer 5 publicly well known. The connecting rod 52 is enclosed with a flexible sealing member 70 which shuts off the interior of the casing 71 from the atmosphere.

According to the construction of the advancer-retarder assembly as mentioned above, when the vacuum pressure in the space defined by the casing 61 and the diaphragm 60 becomes higher than the vacuum pressure in the space defined by the casing 71 and the diaphragm 60, the diaphragm 60 is deflected toward the left. As the result of this deflection, the breaker plate 51 is rotated in a counterclockwise direction through the connecting rod 52, as seen from FIG. 5, and the ignition timing in the distributer 5 is advanced. On the other hand, when the vacuum pressure in the space defined by the casing 71 and the diaphragm 60 becomes higher than the vacuum pressure in the space defined by the casing 61 and the diaphragm 60, the diaphragm 60 is deflected toward the right. As the result of this deflection, the breaker plate 51 is rotated in a clockwise direction through the connecting rod 52, as seen from FIG. 5, and the ignition timing in the distributer is retarded. The deformation of the diaphragm 60 is controlled by the coil springs 62 and 72 and therefore, the spring constant and spring force of each coil spring is desirably selected to obtain the predetermined operation of the diaphragm 60 due to the differential pressure at the opposite sides of the diaphragm 60.

In addition to the vacuum advancer 6 and vacuum retarder 7, the system according to the present invention includes a first and a second valve unit 8 and 9 connected to the vacuum advancer 6, vacuum retarder 7, carburetor 1 and intake manifold 2 by a plurality of conduits.

As shown in FIG. 1, conduit 10 opens at one end thereof in the carburetor 1 at a point downstream of the throttle valve 1*a* and is connected at the other end thereof to the first valve unit 8. A conduit 12 is branched from a conduit 11 connecting the vacuum advancer 6 to the carburetor 1 at a point upstream of the throttle valve 1*a*. This conduit 12 is connected to the first valve unit 8. Another conduit 13 opens at one end thereof in the intake manifold 2 and is connected at the other end thereof to the second valve unit 9. The second valve unit 9 is connected to the vacuum retarder 7 by a conduit 14 and is also connected to the first valve unit 8 by a conduit 15 which is branched from the conduit 14.

The first valve unit 8 includes a closed casing 81 of cylindrical shape. The conduits 12 and 15 are respectively connected to openings formed in the opposite ends of the casing 81, and the conduit 10 is connected to a central opening in the cylindrical wall of the casing 81.

Figure 2:
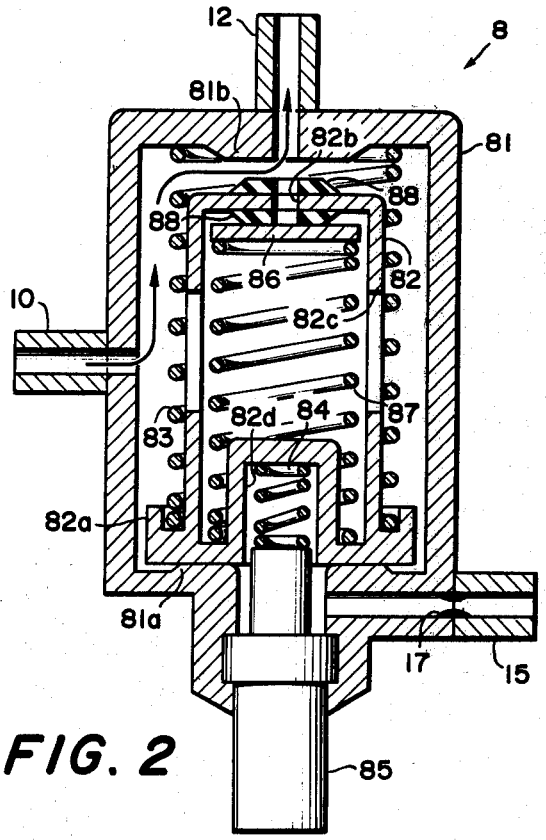
FIG. 2 is an enlarged longitudinal sectional view of the first valve unit shown in FIG. 1 in the state in which the temperature of the engine is low.

The structure of the first valve unit 8 is shown in detail in FIG. 2 and will be described with reference to FIGS. 1 and 2. An annular valve seat 81*a* and a disc-like valve seat 81*b* are respectively formed on the opposite inner ends of the casing 81 of the first valve unit 8, and a hollow cylindrical valve member 82 is disposed within the casing 81 for making selective seating engagement with these valve seats 81*a* and 81*b*. The outer diameter of this valve member 82 is considerably smaller than the inner diameter of the casing 81 as shown in FIG. 2, and therefore, a relatively large space is defined between the inner peripheral surface of the casing 81 and the outer peripheral surface of the valve member 82.

The valve member 82 is brought into seating engagement with one of the valve seats 81*a* and 81*b* formed on the inner end surfaces of the casing 81 while it is urged away from seating engagement with the other valve seat, so that the valve seats 81*a*, 81*b* and valve member 82 constitute a valve assembly for the conduits 12, 15 and 10. A coil spring 83 is loosely mounted around the valve member 82 for causing downward movement of the valve member 82 in the axial direction thereof. This coil spring 83 engages at one end thereof with the upper inner end surface of the casing 81 and at the other end thereof with a flange portion 82*a* of the valve member 82. The valve member 82 is thus normally biased downward in FIG. 2 by the coil spring 83.

A port 82*b* is bored in one end of the valve member 82 to permit communication between the conduit 12 and the internal space of the valve member 82, and a plurality of openings 82*c* are perforated in the cylindrical wall of the valve member 82 to permit communication between the internal space of the valve member 82 and the internal space of the casing 81. A pair of elastic rings 88 each having a bore aligned with the port 82*b* are fixed as by bonding to the outer and inner surfaces of said one end of the valve member 82 to prevent this end of the valve member 82 from making shock-imparting impetuous engagement with the corresponding portion of the cylinder 81.

A cylindrical recess 82*d* is formed at the other end of the valve member 82, and a coil spring 84 is disposed in this recess 82*d*. This coil spring 84 bears at one end thereof against a thermosensor 85 fixed to the casing 81. The thermosensor 85 is generally cylindrical in external appearance and contains therein a substance which expands and contracts in proportion to the temperature of the engine. A valve piece 86 in the form of a disc is disposed within the valve member 82 to close normally the port 82*b* formed in the upper end of the valve member 82. A coil spring 87 is disposed within the valve member 82 so that the valve piece 86 can normally close the port 82*b* by being pressed by the coil spring 87 against the elastic ring 88 fixed to the inner surface of the upper end of the valve member 82.

The second valve unit 9 includes a housing 92 which is partitioned into two chambers 9A and 9B by a diaphragm 91 as shown in FIGS. 1 and 4. The chamber 9A is connected to the conduit 13 which transmits the vacuum in the intake manifold 2, and a diaphragm spring 93 is disposed within this chamber 9A so as to normally shift the diaphragm 91 downward to a position as shown in FIG. 1. The chamber 9B communicates with the atmosphere through a plurality of openings 92*a* formed in the bottom wall of the housing 92, and a valve member 94 connected to the diaphragm 91 is disposed within this chamber 9B so as to normally interrupt communication between the chamber 9B and the conduit 14.

An orifice 16 is provided in the conduit 11 at a position adjacent to the point at which the conduit 11 opens in the carburetor 1, and another orifice 17 is provided in the conduit 15 at a position adjacent to the point at which the conduit 15 is connected to the first valve unit 8. These orifices 16 and 17 are provided so that the pressure on the upstream side of the throttle valve 1*a* in the carburetor 1 and the pressure within the first valve unit 8 may not interfere with the pressures within the conduits 12 and 15 branched from the respective conduits 11 and 14.

The operations of the individual parts of the device of the present invention having the structure above described will now be described in detail with reference to FIGS. 1 to 4.

The thermosensor 85 in the first valve unit 8 is in a contracted state when the temperature of the engine is lower than a certain value, that is, when the engine is being started or when only a short period of time has elapsed after starting of the engine. In such a state, the valve member 82 is not urged away from the valve seat 81*a* by the thermosensor 85 and is seated on the valve seat 81*a* in a manner as shown in FIG. 2. Therefore, communication between the vacuum transmitting conduit 10 and the conduit 15 is interrupted, and the vacuum transmitting conduit 10 communicates with the conduit 12 through the internal space of the casing 81.

Accordingly, the vacuum on the downstream side of the throttle valve 1*a* in the carburetor 1 is supplied into the vacuum advancer 6 through the vacuum transmitting conduit 10, internal space of casing 81, valve seat 81*b*, and conduits 11 and 12 to advance the ignition timing. In this state, the vacuum on the upstream side of the throttle valve 1*a* in the carburetor 1 is not supplied into the vacuum advancer 6 and conduit 12 due to the fact that the orifice 16 is provided in the position adjacent to the point of opening of the conduit 11 into the carburetor 1.

After the engine is started and warmed up, the thermosensor 85 expands upward from the position shown in FIG. 2 to urge the valve member 82 upward away from the valve seat 81*a* as shown in FIG. 3. The movement of the flange portion 82*a* of the valve member 82 away from the valve seat 81*a* permits communication between the conduit 10 and the conduit 15. As a result, the vacuum on the downstream side of the throttle valve 1*a* in the carburetor 1 is now supplied into the vacuum retarder 7 to retard the ignition timing. In this state, the vacuum supplied into the vacuum retarder 7 is proportional to the angular position of the throttle valve 1*a*.

When the throttle valve 1*a* is in the position shown by the solid line in FIG. 1, that is, when the engine warmed up to a temperature above a predetermined value in idling, the pressure in the conduit 11 is positive and the vacuum advancer 6 is not actuated. When subsequently the engine is loaded and the throttle valve 1*a* is swung to the position shown by the two-dot chain line in FIG. 1, the pressure in the conduit 11 is negative and the pressure in the conduit 10 is positive, with the result that the vacuum advancer 6 is energized and the vacuum retarder 7 is deenergized. Thus, the ignition timing is advanced in the loaded state of the engine.

In any one of the cases above described, the second valve unit 9 does not operate unless the vacuum in the intake manifold 2 overcomes the force of the diaphragm spring 93. The second valve unit 9 is placed in operation in such an operating condition of the engine when a vehicle on which the engine is mounted is coasting at a high speed with the throttle valve closed or the brake is applied to the vehicle and a very high vacuum appears in the intake manifold 2. The second valve unit 9 operates to change the ignition timing in a manner as described below.

When a very high vacuum is built up in the intake manifold 2 in such an engine operating condition as when the vehicle is coasting at a high speed or the brake is applied to the vehicle, the diaphragm 91 in the second valve unit 9 is biased upward as seen in FIG. 4 and the valve member 94 connected to the diaphragm 91 is urged upward in FIG. 4 to permit communication of the conduit 14 with the atmosphere via the openings 92*a*. Consequently, the vacuum retarder 7 is deenergized. At the same time, the suction vacuum is supplied into the first valve unit 8 through the conduit 10 to urge the valve piece 86 downward in FIG. 4, so that the suction vacuum is now introduced into the vacuum advancer 6 through the conduit 10, internal space of valve member 82, port 82*b* of valve member 82, and conduits 12 and 11. Thus, the ignition timing is advanced in a degree proportional to the value of the suction vacuum. In this state, the atmospheric pressure on the upstream side of the throttle valve 1*a* in the carburetor 1 is prevented from affecting the pressure in the conduit 11 due to the fact that the orifice 16 is provided in this conduit 11. At the same time, the atmospheric pressure in the conduit 14 is prevented from affecting the pressure in the intake manifold due to the fact that the orifice 17 is provided in the conduit 15.

It will be understood from the foregoing detailed description that the present invention provides an ignition timing change-over system for an internal combustion engine in which the ignition timing can be changed depending on variations of the two variables, that is, the temperature of the engine and the vacuum in the intake manifold, which are variable in various operating conditions of the engine.

The accompanying drawings and the related description are merely illustrative of one form of the present invention, and various changes and modifications may be made therein without departing from the scope of the appended claims. It is apparent to those skilled in the art that, in such changes or modifications, the first and second valve units 8 and 9, for example, may not be of the type illustrated in the accompanying drawings.

I claim:

1. An ignition timing change-over system for connection to an intake manifold of an engine and to a carburetor having a throttle valve for supplying a mixture into the engine and to a distributor having a breaker plate therein, comprising: an ignition timing advancer for connection to a point upstream of the throttle valve for causing the breaker plate to rotate toward an ignition timing advancing direction; an ignition timing retarder for causing the breaker plate to rotate toward an ignition timing retarding direction; a first valve unit responsive to a temperature of the engine and to a predetermined high vacuum pressure in the intake manifold for connecting said ignition timing advancer to a point downstream of the throttle valve when the temperature of the engine is lower than a predetermined level and connecting said ignition timing retarder to the point downstream of the throttle valve when the temperature of the engine is higher than the predetermined level; a second valve unit responsive to the predetermined high vacuum pressure in the intake manifold for communicating said ignition timing retarder with the atmosphere through said second valve unit when the high vacuum pressure arises in the intake manifold and preventing a communication of said ignition timing retarder with the atmosphere when there is no high vacuum pressure in the intake manifold.

2. An ignition timing change-over system as claimed in claim 1, which comprises a first conduit means for connecting said first valve unit to the carburetor at the position downstream of the throttle valve; a second conduit means for connecting said second valve unit to the intake manifold; a third conduit means for connecting said ignition timing advancer to the carburetor at a position upstream of the throttle valve; a fourth conduit means connecting said first valve unit to a midway point of said third conduit means; a fifth conduit means connecting said second valve unit to said ignition timing retarder; a sixth conduit means connecting said first valve unit to a midway point of said fifth conduit means.

3. An ignition timing change-over system as claimed in claim 2, wherein said first valve unit comprises a hollow cylindrical casing connected at opposite ends thereof to said fourth and sixth conduit means respectively, and at a portion of the cylindrical wall of said casing to said first conduit means; a first hollow cylindrical valve member disposed within said casing to be movable in the longitudinal direction of said casing, said valve member being provided at one end with a port communicating with said fourth conduit means and having at the cylindrical wall of said valve member a plurality of openings permitting communication between internal space of said valve member and the internal space of said casing; means for normally urging said valve member within said casing toward the end of said casing connected to said sixth conduit means; a valve piece normally closing said port and disposed within said valve member and opening said port in response to the high vacuum pressure introduced into said casing from the intake manifold; a means disposed within said valve member normally pressing said valve piece against said port in said valve member; and a thermosensor responsive to the temperature of the engine and causing movement of said valve member within said casing toward said fourth conduit means thereby permitting communication between said first conduit means and said sixth conduit means.

4. An ignition timing change-over system as claimed in claim 3, wherein said second valve unit comprises a second valve member for permitting communication between said vacuum retarder and the atmosphere through said fifth conduit means when the vacuum in the intake manifold is higher than a predetermined value.

* * * * *